US012601165B1

(12) United States Patent
Reyes Anzures

(10) Patent No.: US 12,601,165 B1
(45) Date of Patent: Apr. 14, 2026

(54) URINAL ATTACHMENT FOR A TOILET

(71) Applicant: Humberto Carlos Reyes Anzures, Oklahoma City, OK (US)

(72) Inventor: Humberto Carlos Reyes Anzures, Oklahoma City, OK (US)

( * ) Notice: Subject to any disclaimer, the term of this patent is extended or adjusted under 35 U.S.C. 154(b) by 0 days.

(21) Appl. No.: 19/183,453

(22) Filed: Apr. 18, 2025

(51) Int. Cl.
*E03D 13/00* (2006.01)

(52) U.S. Cl.
CPC ..... *E03D 13/007* (2013.01)

(58) Field of Classification Search
CPC ..... E03D 13/00; E03D 13/007; E03D 11/025; A47K 13/08
USPC ..... 4/300.3, 301, 310–312, 340–342, 902, 4/144.1
See application file for complete search history.

(56) References Cited

U.S. PATENT DOCUMENTS 4,282,611 A * 8/1981 O'Day ..... E03D 11/025 4/144.1
4,488,321 A * 12/1984 Brunton ..... E03D 13/00 4/300.3

FOREIGN PATENT DOCUMENTS

DE 19909669 A1 * 9/2000 ..... E03D 11/025
KR 20110022946 A * 3/2011 ..... E03D 13/007

* cited by examiner

*Primary Examiner* — Tuan N Nguyen
(74) *Attorney, Agent, or Firm* — Ruben Alcoba, Esq.

(57) ABSTRACT

A urinal attachment for a toilet comprises a receptacle defining an interior cavity and a front aperture for receiving urine, a cover removably attached to the receptacle and configured to form a fluid-tight seal over the front aperture, and a base for supporting the receptacle in an upright orientation. An articulated connecting bar assembly is hingedly coupled between a rear wall of the receptacle and a hinged connection of the toilet, enabling movement between a stored position and first and second operable positions of differing height. A water dispensing system includes a flexible conduit and a faucet assembly integrated into the cover, and is configured to dispense pressurized water into the cavity for cleaning when the cover is closed. A blackwater discharge system includes a flexible conduit connected to a lower wall opening and configured to convey waste to the toilet bowl. The connecting bar assembly may be length-adjustable or telescopic to accommodate variable toilet geometries.

9 Claims, 7 Drawing Sheets

URINAL ATTACHMENT FOR A TOILET

BACKGROUND

The present invention is directed to a urinal attachment for a toilet for improved functionality. Toilets are widely used sanitary fixtures designed to accommodate human waste elimination in both residential and commercial settings. Standard toilet designs commonly include a toilet bowl, seat, and cover, and are generally intended to support a seated or standing position during use. However, traditional toilet configurations often present hygiene challenges, particularly when used by standing users (e.g., adult males or children), due to splashing and poor aim, which result in unsanitary conditions such as urine residue on the toilet rim, floor, or adjacent surfaces. These issues are particularly problematic in shared or high-traffic bathrooms, where maintenance frequency may be insufficient to address ongoing hygiene concerns.

Various attempts have been made to mitigate urine splash and improve cleanliness around toilet areas. Conventional solutions include the use of urinal mats, splash guards, or integrated toilet-urinal hybrid designs. While these approaches may reduce splash to some extent, they are limited by several drawbacks. Splash guards and mats do not prevent urine from entering the toilet bowl, and must be cleaned or replaced regularly. Hybrid fixtures or urinals require dedicated plumbing, wall installation, or structural modifications, making them unsuitable for retrofitting standard residential toilets. Portable urinals and detachable receptacles also exist, but typically lack secure mounting, offer limited adjustability, and require manual emptying, increasing the risk of spillage and odors.

Accordingly, there remains a need for an improved urinal solution that can be retrofitted to existing toilets without requiring permanent modifications, while enhancing hygiene for standing users and simplifying maintenance.

The present invention addresses the above-identified shortcomings by providing a urinal attachment for a toilet that includes a dedicated, self-cleaning urination receptacle coupled to the toilet via an articulated connecting bar assembly. The receptacle is configured to transition between a stored position and two operable positions of different height, thereby accommodating users of varying statures. A water dispensing system integrated into the receptacle's cover enables automated or manual internal rinsing following use, while a blackwater discharge system directs waste into the toilet bowl, eliminating the need for manual disposal.

SUMMARY

The present invention relates to a urinal attachment for a toilet designed to improve functionality and hygiene, particularly for standing users, from adult males to children. The object of the invention is to provide a self-cleaning, space-saving urination receptacle that prevents urine splash, maintains a clean toilet bowl, and is compatible with existing toilet systems without requiring permanent structural modifications.

The invention comprises a receptacle for urination that defines a front aperture, a rear wall, and side walls, collectively forming an interior cavity. A removable cover is configured to form a fluid-tight seal over the front aperture, preventing odors and contamination. The attachment further includes a base that supports the receptacle in an self-standing upright orientation and an articulated connecting bar assembly that hingedly connects the receptacle to the toilet cover hinge. This allows the receptacle to transition between a stored position and two adjustable operable positions, accommodating users of varying heights.

A water dispensing system integrated into the cover cleans the interior cavity of the receptacle after each use by releasing pressurized water, ensuring hygienic operation. The blackwater discharge system facilitates the transfer of waste from the receptacle into the toilet bowl, preventing any contact with or manual handling of urine. The entire system operates efficiently without the need for additional plumbing or modifications to the toilet.

The invention provides several advantages, including improved hygiene, easy installation, hands-free waste disposal, and compatibility with different toilet geometries. Additionally, the system allows for height-adjustable positioning, making it adaptable for both children and adults, and its compact design ensures minimal space usage when not in operation.

BRIEF DESCRIPTION OF THE DRAWINGS

These and other features, aspects, and advantages of the present invention will become better understood with regards to the following description, appended claims, and drawings where:

DESCRIPTION

Figure 1:
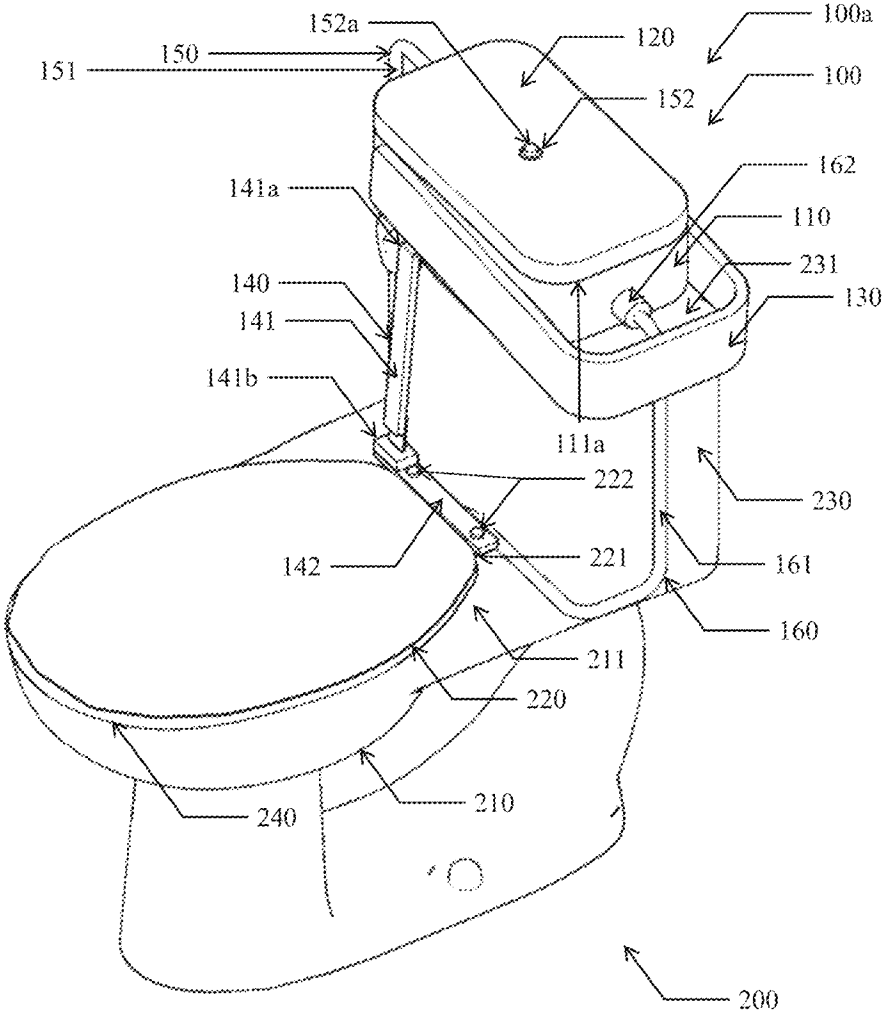
FIG. 1 is a front perspective view of the present invention in the stored position.
Figure 2:
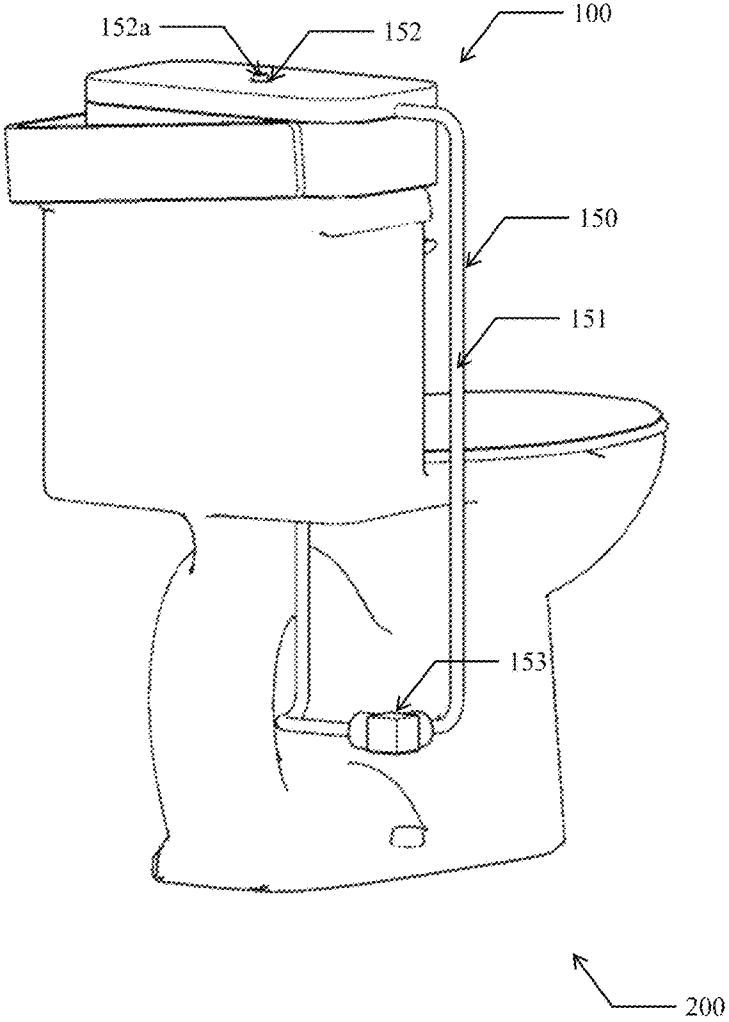
FIG. 2 is a back perspective view of the present invention in the stored position.
Figure 3:
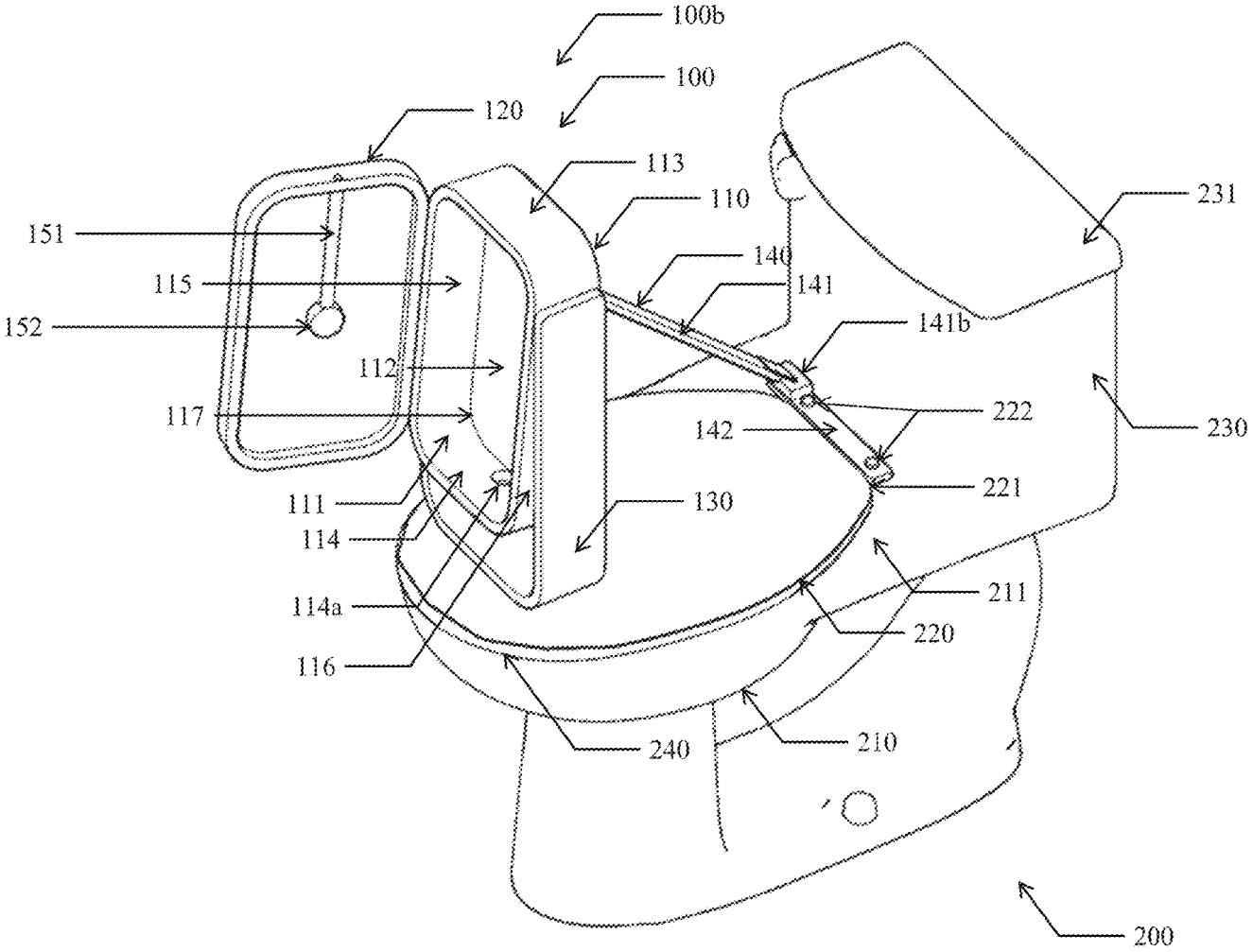
FIG. 3 is a front perspective view of the present invention in the first operable position (flexible water supply conduit and flexible blackwater discharge conduit not shown for clarity)
Figure 4:
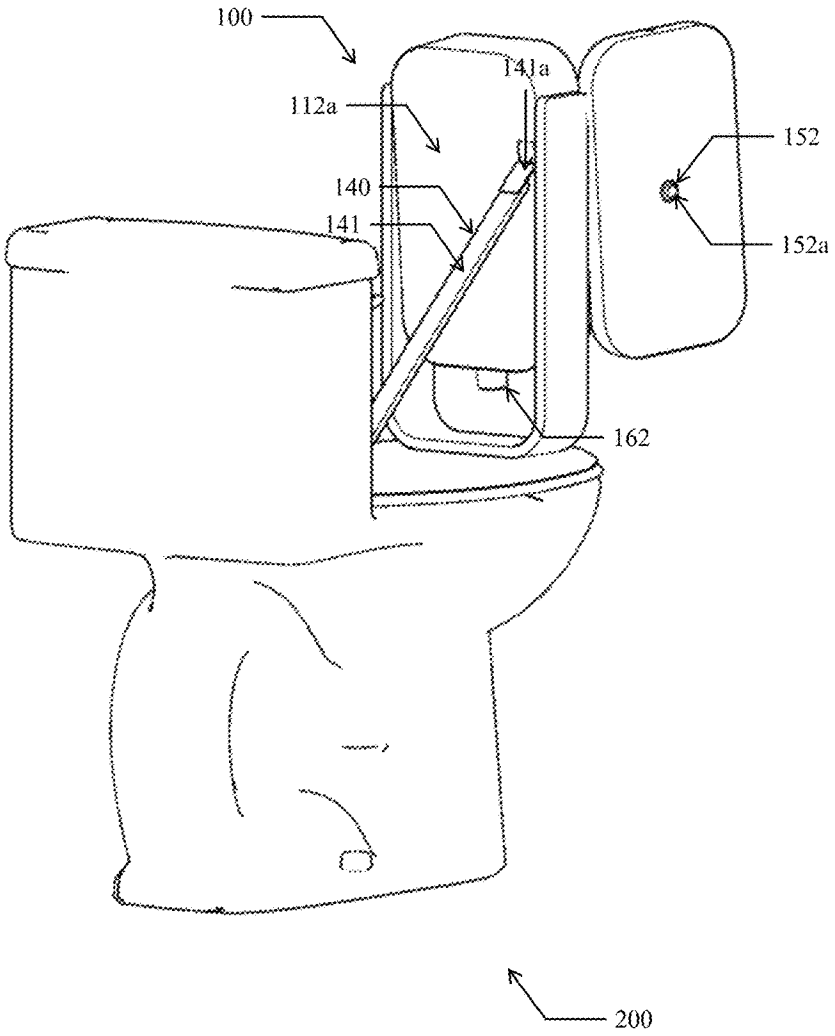
FIG. 4 is a back perspective view of the present invention in the first operable position (flexible water supply conduit and flexible blackwater discharge conduit not shown for clarity)
Figure 5:
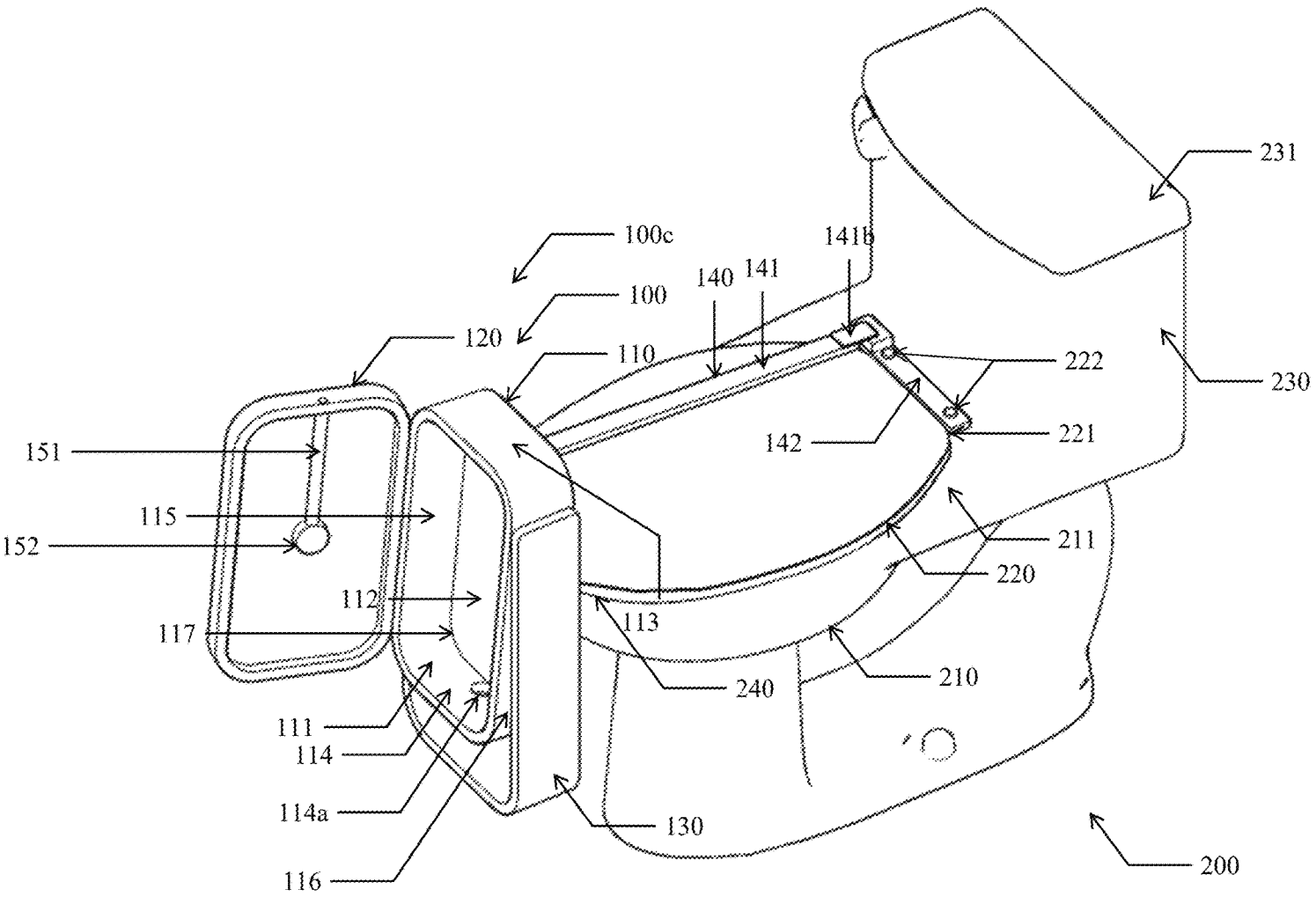
FIG. 5 is a front perspective view of the present invention in the second operable position (flexible water supply conduit and flexible blackwater discharge conduit not shown for clarity)
Figure 6:
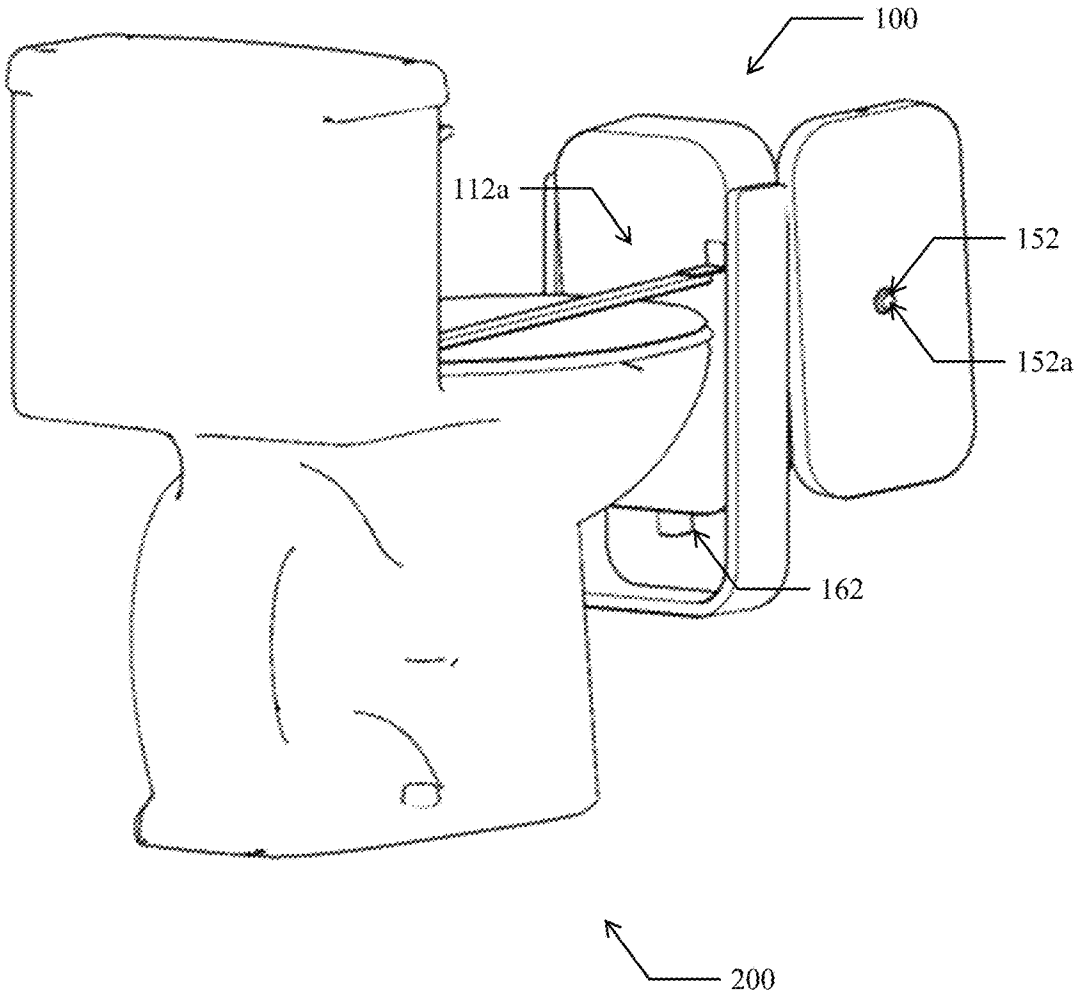
FIG. 6 is a back perspective view of the present invention in the second operable position (flexible water supply conduit and flexible blackwater discharge conduit not shown for clarity)
Figure 7:
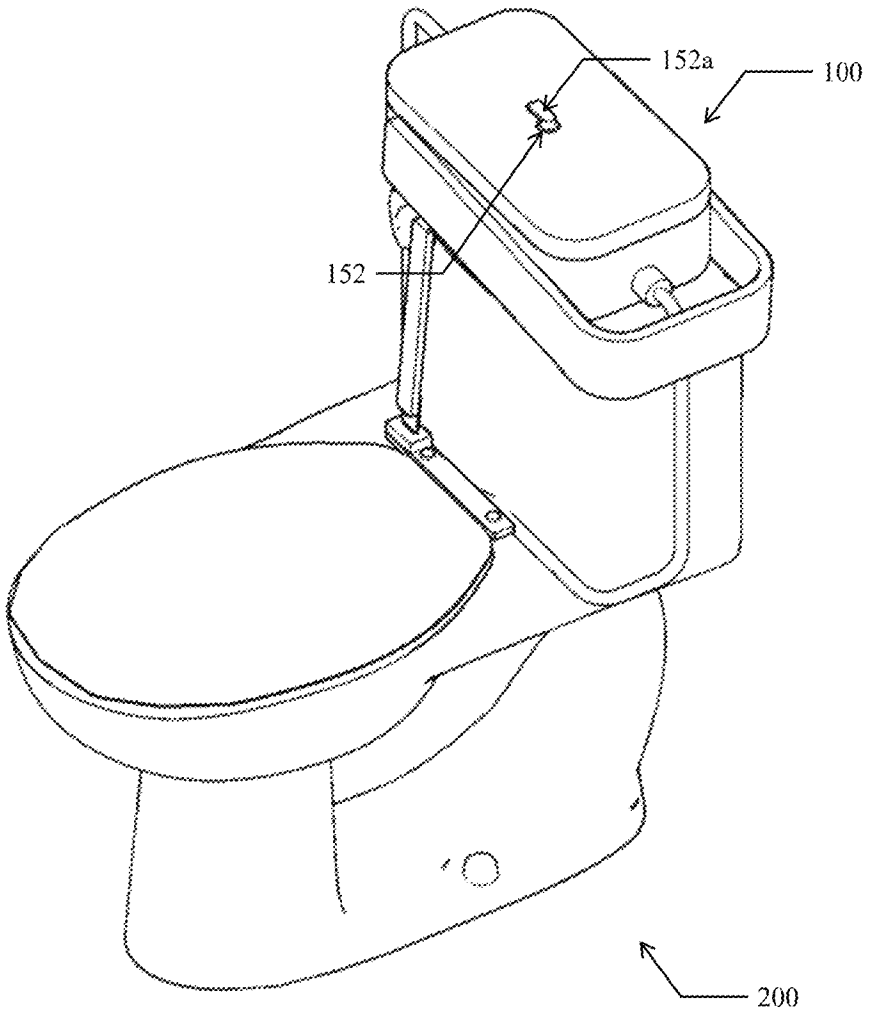
FIG. 7 is a front perspective view of the present invention in the stored position wherein the faucet assembly comprises a lever instead of a button to actuate the water dispensing system.

As seen in FIGS. 1-7, the present invention is a urinal attachment 100 for a toilet 200 for improved functionality.

The urinal attachment 100 comprises a receptacle 110 for urination that defines a front aperture 111, a rear wall 112, an upper wall 113, a lower wall 114, a left wall 115 and a right wall 116 that collectively define an interior cavity 117, urination is directed to the interior cavity 117 through the front aperture 111. A cover 120 removably attached to the receptacle 110, the cover 120 is configured to close the front aperture 111 and form a fluid-tight seal 111*a*. A base 130 configured to support the receptacle 110 in a self-standing upright orientation. An articulated connecting bar assembly 140 that extends from an exterior surface 112*a* of the rear wall 112 of the receptacle 110 to a hinged connection 221 between a toilet cover 220 and a toilet bowl 210, the articulated connecting bar assembly 140 hingedly connects the urinal attachment 100 to the toilet 200, allowing their relative movement. A water dispensing system 150 configured to clean the interior cavity 117 of the receptacle 110 after urination, the water dispensing system 150 comprises a flexible water supply conduit 151 and a faucet assembly 152, the flexible water supply conduit 151 transports water from a water source 153 to the faucet assembly 152, the faucet assembly 152 is integrated into the cover 120 and is configured to controllably release pressurized cleaning water into the interior cavity 117 of the receptacle 110 when its front aperture 111 is closed. And a blackwater discharge system 160 configured to discharge blackwater from the interior cavity 117 of the receptacle 110 to the toilet bowl 210, the blackwater discharge system 160 comprises a flexible blackwater discharge conduit 161 connected to an opening 114*a* in the lower wall 114 of the receptacle 110 that transports blackwater from the interior cavity 117 of the receptacle 110 to the toilet bowl 210. Wherein the urinal attachment 100 defines a stored position 100*a*, a first operable position 100*b* and a second operable position 100*c*. Wherein at least a portion of the exterior surface 112*a* of the rear wall 112 of the receptacle 110 rests on a top surface 231 of a toilet deposit 230 in the stored position 100*a*. Wherein the base 130 rests on the toilet cover 220 and supports the receptacle 110 in its self-standing upright orientation in the first operable position 100*b*, the cover 120 is configured to keep the front aperture 111 of the receptacle 110 open for urination in the first operable position 100*b*. Wherein the receptacle 110 rests on a front portion 240 of the toilet 200 in the second operable position 100*c*, the cover 120 is configured to keep the front aperture 111 of the receptacle 110 open for urination in the second operable position 100*c*. Wherein the first operable position 100*b* is higher than the second operable position 100*c*, thereby accommodating variable user heights. Wherein the water dispensing system 150 is configured to be actuated for cleaning the interior cavity 117 of the receptacle 110 after urination when the front aperture 111 is closed. And wherein the articulated connecting bar assembly 140 enables the transition between the stored position 100*a*, the first operable position 100*b* and the second operable position 100*c* without requiring disconnecting the urinal attachment 100 from the toilet 200.

In an embodiment of the present invention, the articulated connecting bar assembly 140 comprises a bar 141 and a flattened elongated segment 142, the bar 141 defines a first end 141*a* and a second end 141*b*, the first end 141*a* of the bar 141 is hingedly connected to the exterior surface 112*a* of the rear wall 112 of the receptacle 110, the second end 141*b* of the bar 141 is hingedly connected to the flattened elongated segment 142, the flattened elongated segment 142 is rigidly connected to the hinged connection 221 between the toilet cover 220 and the toilet bowl 210 through a set of screws 222 configured to secure the toilet cover 220 to the toilet bowl 210.

In another embodiment of the present invention, the bar 141 of the articulated connecting bar assembly 140 is length-adjustable to accommodate variable toilet geometries.

In another embodiment of the present invention, the bar 141 of the articulated connecting bar assembly 140 is telescopic.

In another embodiment of the present invention, the flexible blackwater discharge conduit 161 of the blackwater discharge system 160 is fitted and retained between the flattened elongated segment 142 and an upper surface 211 of the toilet bowl 210.

In another embodiment of the present invention, the faucet assembly 152 comprises a button 152*a* to actuate the water dispensing system 150.

In another embodiment of the present invention, the faucet assembly 152 comprises a lever 152*b* to actuate the water dispensing system 150.

In another embodiment of the present invention, the blackwater discharge system 160 further comprises a valve 162 installed at or near the opening 114*a* in the lower wall 114 of the receptacle 110 and configured to selectively permit or prevent the passage of blackwater.

In yet another embodiment of the present invention, the urinal attachment is made of a plastic.

An advantage of the present invention is its ability to address hygiene issues caused by standing urination generally associated with male users. It offers a dedicated target area that improves aim and reduces mess compared to a shared toilet bowl. The urinal attachment keeps the toilet bowl clean by providing a separate receptacle for urination that ensures urine is collected away from the toilet bowl, significantly reducing splashback on the toilet bowl rim and floor, and therefore stains and odor buildup in and around the toilet bowl.

Another advantage of the present invention is its built-in cleaning system. The water dispensing system enables automatic internal cleaning of the urinal receptacle, enhances hygiene and user convenience, integrates a button or lever for easy actuation, and keeps urine odors and stains minimized through pressurized water cleaning.

Another advantage of the present invention is its efficient waste management system. The blackwater discharge system directs waste into the toilet bowl, using a flexible conduit for easy routing, may include a valve to address leakages or odors and facilitate maintenance, promotes cleanliness and sanitary disposal without manual emptying, and makes the urinal attachment suitable for regular use in shared or public restrooms.

Another advantage of the present invention is its flexibility and user-friendly design. The urinal attachment operates in two height positions to serve from adult men to young children learning to use the toilet. The use of lightweight materials such as plastics as well as its compact and articulated design provides increased maneuverability. It also offers an effective cleaning system that can be easily actuated by all target users.

Another advantage of the present invention is that it offers a discreet and hygienic storage. The sealed cover prevents odors from escaping when not in use, and its storage on the toilet deposit when not needed saves space and keeps it out of the way and integrated with the toilet design. Its compactness and space-saving quality makes it ideal for small bathrooms and settings where permanent urinals are impractical.

Another advantage of the present invention is its convenient and non-invasive integration. The articulated connecting bar assembly allows the urinal attachment to stay permanently and securely attached to the toilet, move smoothly between positions (stored, first operable and second operable positions) without disconnecting, be adjustable (length-adjustable options, including but not limited to a telescopic design) to fit various toilet geometries, and avoid the need for modifying existing toilet infrastructure. The present invention does not require additional plumbing either. The same water source for the toilet can also be used for the urinal attachment by simply coupling a dual-inlet valve to supply water to both the toilet and the urinal attachment.

Still another advantage of the present invention is that it is practical, durable, and low-maintenance. Its plastic construction is lightweight, corrosion-resistant, and easy to clean. It is simple to install and its operability and use are intuitive, making it suitable for home bathrooms, schools, care facilities, and public restrooms.

The embodiments of the urinal attachment for a toilet for improved functionality herein are exemplary and numerous modifications, combinations, variations, and rearrangements can be readily envisioned to achieve an equivalent result, all of which are intended to be embraced within the scope of the appended claims. Further, nothing in the above-provided discussions of the urinal attachment for a toilet for improved functionality should be construed as limiting the invention to an embodiment or a combination of embodiments. The scope of the invention is defined by the description, drawings, and claims.

What is claimed is:

1. A urinal attachment for a toilet for improved functionality, the urinal attachment comprises:

a receptacle for urination that defines a front aperture, a rear wall, an upper wall, a lower wall, a left wall and a right wall that collectively define an interior cavity, urination is directed to the interior cavity through the front aperture;

a cover removably attached to the receptacle, the cover is configured to close the front aperture and form a fluid-tight seal;

a base configured to support the receptacle in a self-standing upright orientation;

an articulated connecting bar assembly that extends from an exterior surface of the rear wall of the receptacle to a hinged connection between a toilet cover and a toilet bowl, the articulated connecting bar assembly hingedly connects the urinal attachment to the toilet, allowing their relative movement;

a water dispensing system configured to clean the interior cavity of the receptacle after urination, the water dispensing system comprises a flexible water supply conduit and a faucet assembly, the flexible water supply conduit transports water from a water source to the faucet assembly, the faucet assembly is integrated into the cover and is configured to controllably release pressurized cleaning water into the interior cavity of the receptacle when its front aperture is closed; and a blackwater discharge system configured to discharge blackwater from the interior cavity of the receptacle to the toilet bowl, the blackwater discharge system comprises a flexible blackwater discharge conduit connected to an opening in the lower wall of the receptacle that transports blackwater from the interior cavity of the receptacle to the toilet bowl;

wherein the urinal attachment defines a stored position, a first operable position and a second operable position;

wherein at least a portion of the exterior surface of the rear wall of the receptacle rests on a top surface of a toilet deposit in the stored position;

wherein the base rests on the toilet cover and supports the receptacle in its self-standing upright orientation in the first operable position, the cover is configured to keep the front aperture of the receptacle open for urination in the first operable position;

wherein the receptacle rests on a front portion of the toilet in the second operable position, the cover is configured to keep the front aperture of the receptacle open for urination in the second operable position;

wherein the first operable position is higher than the second operable position, thereby accommodating variable user heights;

wherein the water dispensing system is configured to be actuated for cleaning the interior cavity of the receptacle after urination when the front aperture is closed; and wherein the articulated connecting bar assembly enables the transition between the stored position, the first operable position and the second operable position without requiring disconnecting the urinal attachment from the toilet.

2. The urinal attachment for a toilet for improved functionality of claim 1, wherein the articulated connecting bar assembly comprises a bar and a flattened elongated segment, the bar defines a first end and a second end, the first end of the bar is hingedly connected to the exterior surface of the rear wall of the receptacle, the second end of the bar is hingedly connected to the flattened elongated segment, the flattened elongated segment is rigidly connected to the hinged connection between the toilet cover and the toilet bowl through a set of screws configured to secure the toilet cover to the toilet bowl.

3. The urinal attachment for a toilet for improved functionality of claim 2, wherein the bar of the articulated connecting bar assembly is length-adjustable to accommodate variable toilet geometries.

4. The urinal attachment for a toilet for improved functionality of claim 3, wherein the bar of the articulated connecting bar assembly is telescopic.

5. The urinal attachment for a toilet for improved functionality of claim 2, wherein the flexible blackwater discharge conduit of the blackwater discharge system is fitted and retained between the flattened elongated segment and an upper surface of the toilet bowl.

6. The urinal attachment for a toilet for improved functionality of claim 1, wherein the faucet assembly comprises a button to actuate the water dispensing system.

7. The urinal attachment for a toilet for improved functionality of claim 1, wherein the faucet assembly comprises a lever to actuate the water dispensing system.

8. The urinal attachment for a toilet for improved functionality of claim 1, wherein the blackwater discharge system further comprises a valve installed at or near the opening in the lower wall of the receptacle and configured to selectively permit or prevent the passage of blackwater.

9. The urinal attachment for a toilet for improved functionality of claim 1, wherein the urinal attachment is made of a plastic.

* * * * *